US006439123B1

(12) United States Patent
Dionne et al.

(10) Patent No.: US 6,439,123 B1
(45) Date of Patent: Aug. 27, 2002

(54) TRAINING CARTRIDGE

(75) Inventors: Sylvain Dionne, Mirabel; Nathalie Gauthier, Boucherville, both of (CA)

(73) Assignee: SNC Technologies Inc., Quebec (CA)

( * ) Notice: Subject to any disclaimer, the term of this patent is extended or adjusted under 35 U.S.C. 154(b) by 0 days.

(21) Appl. No.: 09/651,108

(22) Filed: Aug. 30, 2000

(51) Int. Cl.[7] ..... F42B 5/02
(52) U.S. Cl. ..... 102/430; 102/444; 102/530
(58) Field of Search ..... 102/430, 434, 102/439, 444, 447, 464, 530

(56) References Cited

U.S. PATENT DOCUMENTS 4,173,186 A 11/1979 Dunham
4,553,480 A * 11/1985 McLellan ..... 102/430
5,016,536 A * 5/1991 Brighton ..... 102/444
5,035,183 A * 7/1991 Luxton ..... 102/447
5,086,703 A 2/1992 Klein
5,359,937 A * 11/1994 Dittrich ..... 102/444
5,492,063 A * 2/1996 Dittrich ..... 102/444
5,677,505 A * 10/1997 Dittrich ..... 102/444
6,253,682 B1 7/2001 Saxby

FOREIGN PATENT DOCUMENTS

AT 357445 * 7/1980 ..... 102/444
WO WO 98 41810 9/1998

* cited by examiner

*Primary Examiner*—Harold J. Tudor
(74) *Attorney, Agent, or Firm*—David J. French

(57) ABSTRACT

A telescopic training round has an inner sealant disc with a central hole to ensure against gas leakage as the casing expands telescopically.

17 Claims, 5 Drawing Sheets

TRAINING CARTRIDGE

FIELD OF THE INVENTION

This invention relates to cartridges for firearms that operate, or are converted to operate, on the blow-back principle. It is particularly suited for use as training ammunition for firing low mass training projectiles, such as that described in U.S. Pat. No. 5,035,183.

BACKGROUND TO THE INVENTION

A number of telescopically expanding cartridge cases have been developed to facilitate the operation of blow-back cycling firearms. Such rounds are needed when a low mass projectile is being fired as the recoil in such cases is greatly diminished.

Examples of such prior art rounds are described in U.S. Pat. Nos. 5,359,937 and 5,016,536.

An objective in the designing of such rounds is the minimization of cost. Various materials including plastics and metals may be employed. A further factor for consideration is that a training round which is intended to operate in a minimally converted, standard, firearm should chamber and eject reliably, in the same manner as a normal round. For these and other reasons it is desirable to rely on metals. However, it is difficult to achieve high sealing efficiencies between sliding metal surfaces.

In the case of rounds with telescopically expanding casings, a tight sliding fit is required between parts to contain propellant gases during the cartridge expansion action. This type of fit is difficult to achieve with all-metal parts, and even when non-metal materials are employed.

The present invention addresses the problem of providing a seal under such circumstances.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention in one aspect a telescopically expanding cartridge equipped with a projectile or formatted as a blank comprises a two part casing portion, which portions are telescopically interfitted into each other over an overlapping region. One "head end" portion of the casing carries the head end of the cartridge and the other, forward, portion constitutes the chambering end portion of the casing, hereafter referred to as the "plug".

When assembled, the rearward end of the plug fits, in one variant with a close sliding fit, into a sleeve that is part of the head end portion of the casing. The plug rearward end terminates in a transverse wall pierced by an orifice. An interior passage extends axially from this orifice to the forward end of the casing, providing a path for propellant gases to escape through the orifice and propel a projectile, if present. The transverse wall and inside surfaces of the sleeve and head end delimit an internal volume or cavity within the casing.

Fitted against the transverse wall within the internal volume is a sealing disc of flexible, compliant, preferably polymeric material. This disc is dimensioned to effect a tight sliding fit, preferably an interference fits against the inner wall of the sleeve. It contains a central hole aligned with the orifice in the transverse wall of the plug. This central hole may function as a "choke hole" to allow gases evolving in the inner cavity to escape in a metered manner from the cavity, out through the end wall orifice. Alternately, a choke hole may be formed in the transverse wall as the end wall orifice, accessed through a simple hole in the disc.

Optionally but preferably a frangible membrane overlies the choke hole to seal-out moisture before the firing of the round. Ignition of propellant within the inner cavity ruptures this membrane.

On firing, gases evolving in the inner cavity develop an over-pressure that causes the casing to expand telescopically. The overlapping portion of the plug slides within the sleeve as the gap between the transverse wall and head end increases. Pressure is applied to the plug through the sealing disc which travels forwardly with the plug with respect to the sleeve. Throughout its travel, the sealing disc minimizes the loss of gases through the plug/sleeve interface.

The invention is particularly suited to the situation where the sleeve is made of brass and the plug is made of zinc, or a zinc alloy.

To position the sealing disc accurately, according to one variant, the transverse wall may have a recess or protrusion, preferably circular, and the disc may have a correspondingly shaped.

The rearward end of the plug need not be in direct contact with the inside surface of the sleeve to provide a close sliding fit.

The sealing disc may also or alternately have a thin, axial extending rim located on the outer periphery of the disc and embracing the outer perimeter of the rearward end of the plug to seal against the interior wall passageway of the sleeve. This rim is thrust against the sleeve walls under the gas pressure developed by the propellant upon firing, increasing the sealing properties of the disc. This rim can also provide an alternate or supplementary means for positioning the disc centrally on the rearward end of the plug.

To assist in assembly, this rim may have a hooked edge that lockingly engages with a circumferential flange formed at the rearward end of the plug. The disc may be made of a resilient material to permit the disc to be pressed into position on the rearward end with a "snap" fit.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
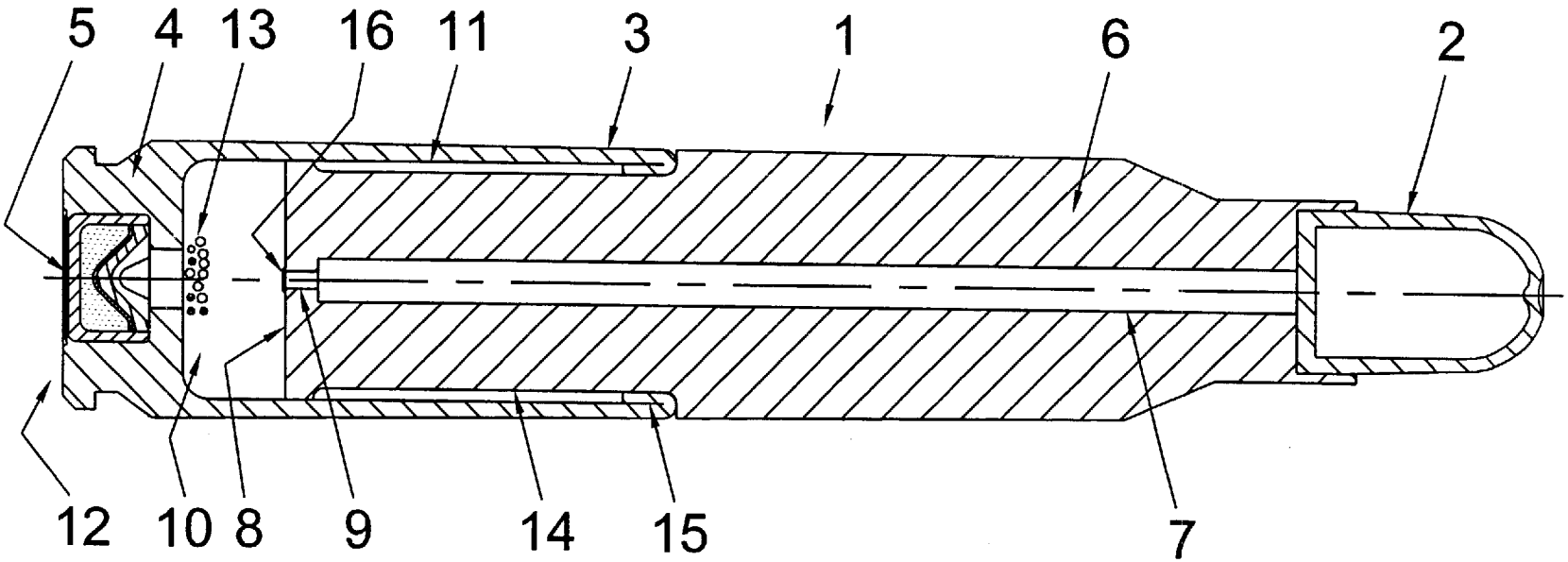
FIGURE 1 PRIOR ART
FIG. 1 is a side cross-sectional view of an existing, prior art round with a telescopically expanding casing.

In FIG. 1 a prior art training round 1 is fitted with a light weight projectile 2 at the forward end of a telescopically expanding casing 3. The casing 3 has a head end portion 4 with a primer 5 and a chambering end portion 6 also sometimes referred-to as a plug 6.

A central passageway 7 extends the length of the chambering portion 6 of the casing. At the rearward end of this passageway 7, a transverse wall 8 is pierced by an orifice 9 that closes-off the greater part of the passageway 7 defining an inner cavity 20 between the wall 8, a cylindrical sleeve 11 on the head end portion 4 of the casing 3 and the actual head end 12 itself Propellant powder 13 is present within the cavity 10.

The transverse wall 8 terminates along its outer periphery against the inner side of the sleeve 11. The sleeve 11 extends to overlap a portion of the rearward extent of the chambering portion 6. An indented region 14 formed in this part of the chambering portion 6 accepts an inwardly bent crimp 15 on the sleeve 11 that functions to limit the telescopic expansion of the casing 3.

In the prior art, the orifice 9 is covered by a frangible membrane 16 to prevent moisture from reaching the propellant 13.

Figure 2:
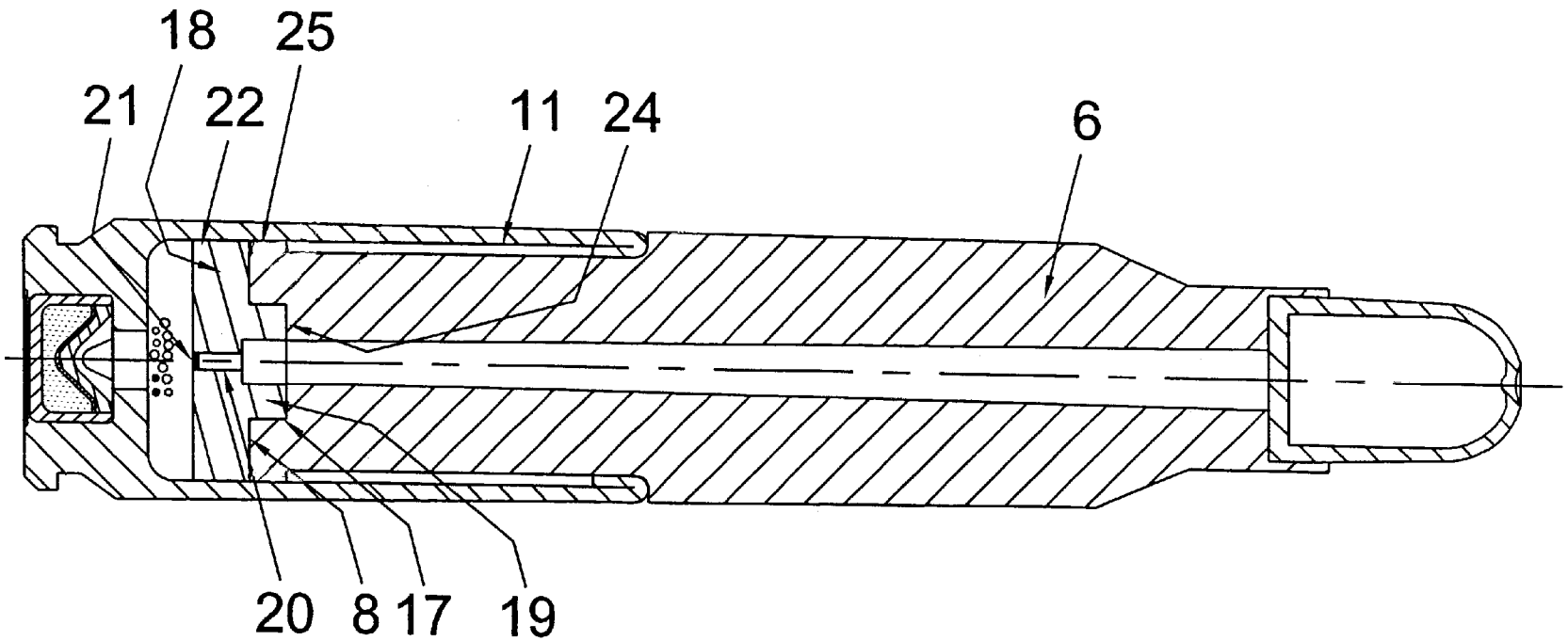
FIG. 2 is FIG. 1 modified by the presence of the sealing disc of the invention.
Figure 3:
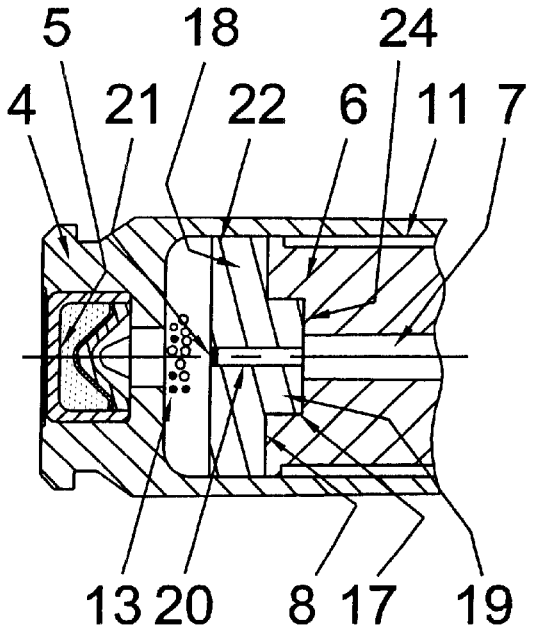
FIG. 3 is an enlarged, side cross-sectional view of the rearward end of the chambering portion of the round of FIG. 2.

In FIGS. 2 and 3 the transverse wall 8 has an enlarged recess 17 with an annular seat 24 formed in place of the orifice 9 of FIG. 1. A sealing disc 18, preferably of polymeric material, has a protrusion 19 that interfits with this recess 17. The sealing disc 18 has a centrally located choke hole 20 covered by a frangible membrane 21. The outer circumferential edge 22 of the sealing disc 18 is dimensioned to effect a tight sliding fit against the inner surface of the sleeve 11.

On firing, the chambering portion 6 and sealing disc 18 both move with respect to the sleeve 11 as the casing 3 telescopically expands under the pressure of gas 26 evolving from the propellant powder 13, The outer circumferential edge 22 of the disc 18 contains such gases 26 from leaking-out through the transverse wall 18/sleeve 11 interface.

In this manner a improved training round with more reliable performance is provided.

Figure 4:
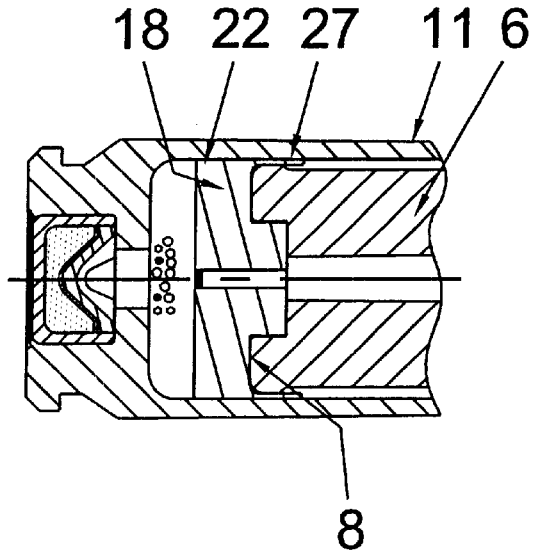
FIG. 4 is a variant of FIG. 3 wherein the sealing disc has a peripheral rim.

In FIG. 4 the outer circumferential edge 22 is modified by a thin, axially extending rim 27 that extends between the chambering portion 6 and the inner wall of the sleeve 11. This rim 27 eliminates direct contact between the outer end of the transverse wall 8 and the sleeve 11, further improving the seal therebetween.

Figure 5:
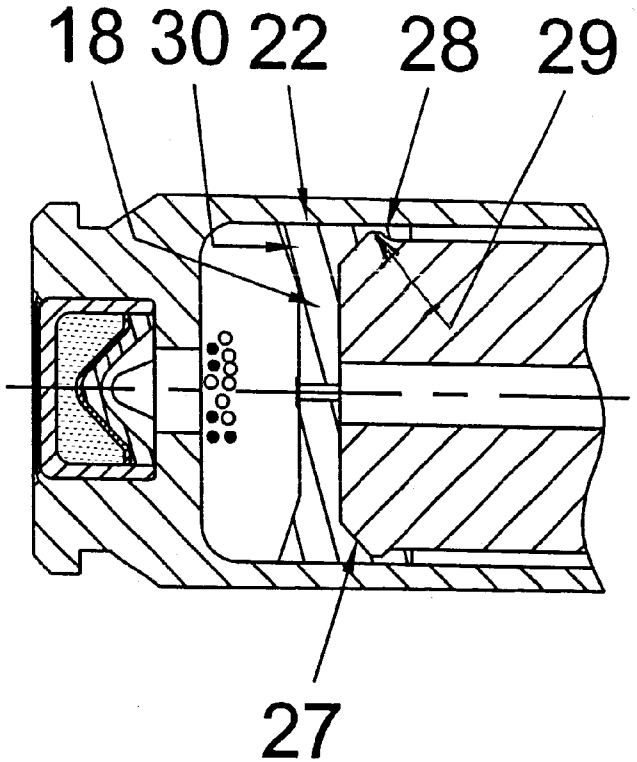
FIG. 5 is a further variant of FIG. 3 wherein the sealant disc rim has a lip.

In FIG. 5 the outer edge 22 of the disc 18 has a snap-fit lip 28 on the outer rim 27 that engages with a conically inclined circular flange 29, on the chambering portion 6. These parts interengage to secure the disc 18 centrally to the chambering portion 6. This makes the protrusion 19 on the sealing disc and recess 17 in the transverse wall 8 redundant as positioning means.

As a further feature shown in FIG. 5, the rim 22 of the disc 18 has a ramped flange 30 that lies against the inner wall of the sleeve 11. Pressure from evolving gas 26 will press this flange 30 against the inner wall of the sleeve 11, additionally securing against gas leakage.

Figure 6:
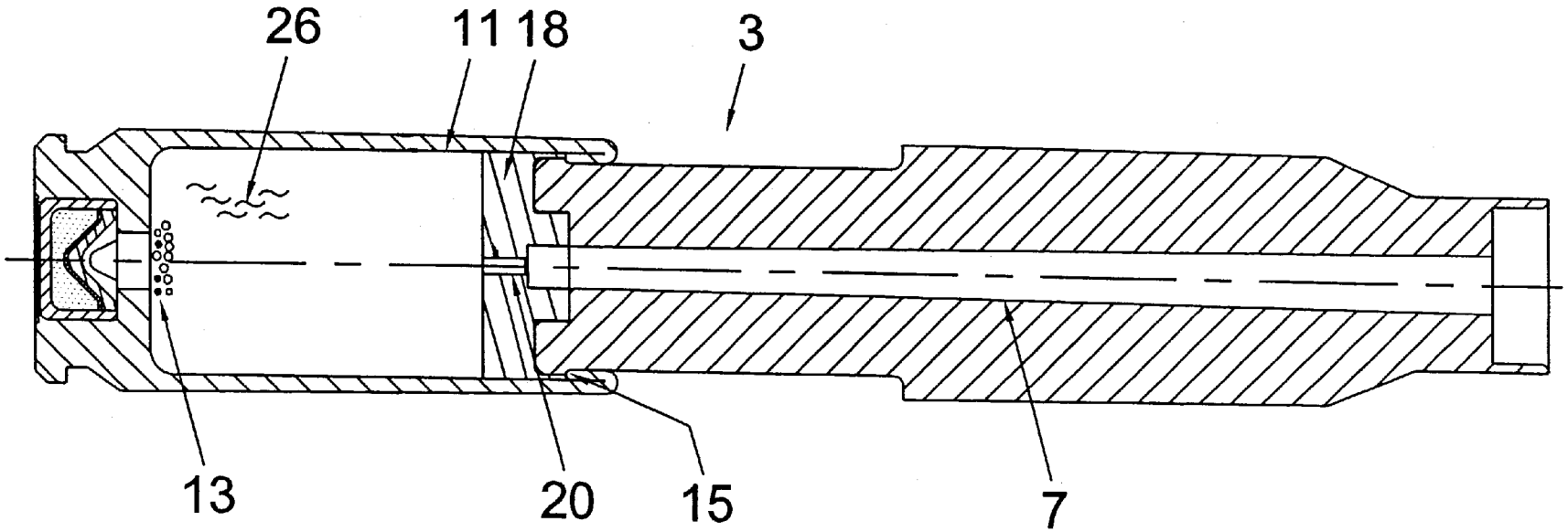
FIG. 6 is a side cross-sectional view of the round of FIG. 1, modified as in FIG. 2 in its expanded state after firing.

In FIG. 6 the expanded round, is depicted, showing the chambering portion 6 telescopically expanded from within the sleeve 11. The membrane 21 has ruptured under the pressure of expanding gas 6. The projectile 2 has been fired through the bore of the weapon (not shown) by gas 26 travelling through the choke hole 20 and central passageway 7. Telescopic expansion is limited by the travel of the crimp 15 in the groove 14.

The sealing disc 18 is preferably made of a polymeric plastic such as polyoxymethylene acetyl. This material permits the membrane 21 to be integrally molded into the sealing disc 18.

The chambering portion may be of any material that requires supplementary sealing, particularly aluminum, zinc and zinc alloys. A preferred material is a zinc alloy containing copper, aluminum and magnesium sold under the brand name "Zamak" held by the New Jersey Zinc Company of New Jersey and by the Canadian company Dynacast Limited of Lachine, Quebec.

The sealing disc 18 can be fitted into a 5.56 mm round with an outer diameter of 0.330 inches, providing an 0.0025 inch interference fit. The preferred embodiment of the Figures has been built using DELRIN™ with an annular portion 25 of 0.150 inches in diameter and 0.100 inches thickness. The protrusion extends 0.050 inches out from the annular portion 25. The choke hole was 0.023 inches in diameter and the membrane thickness was 0.0035 inches.

With the rim 27 added as in FIG. 4, the rim 27 protruded 0.080 inches from the annular portion 25.

While FIGS. 3 and 4 show a sealing disc 18 with a protrusion, the transverse wall may present a protrusion or post over which a disc with a central hole (not shown) may be fitted with a tight fit. In such an arrangement, the post on the chambering portion carries the choke hole.

Either configuration will stabilize the disc 18 on the plug 6 for ease of assembly and to minimize gas loss along the transverse wall 8/disc 18 interface.

FIG. 5 depicts a sealing disc 18 that is coupled to the plug 6 by the lip 28 on its outer edge.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A telescopically expanding cartridge for use in blow-back operated firearms comprising:

1) a casing with a head end portion including a cartridge head end fitted to a sleeve and a chambering portion at least partially positioned within said sleeve;

2) the chambering portion being telescopically interfitted with said sleeve with a containing engagement, said chambering portion having a forward end, remote from the head end, and a rearward end defining a cavity containing a propellant to evolve gas on firing;

3) the chambering portion comprising a longitudinal passageway extending from its forward end to its rearward end;

4) a recess or protrusion formed in the rearward end of the chambering portion;

5) a sealing disc having a complementary disc protrusion or disc recess interfitted into said recess or protrusion and an annular portion overlying the rearward end of the chambering portion, extending to form at its outer circumferential perimeter a sealing contact with said sleeve, wherein the sealing disc is pierced by a hole to allow a metered release through the longitudinal passageway of gas evolving from within the cartridge cavity upon firing.

2. A cartridge as in claim 1 wherein said sealing disc comprises a frangible membrane covering said hole.

3. A cartridge as in claim 1 wherein a rim extends from the outer circumferential perimeter of the sealing disc to lie between the chambering portion and the cartridge sleeve.

4. A telescopically expanding cartridge for use in blowback operated firearms comprising:

1) a casing with a head end portion including a cartridge head end fitted to a sleeve;

2) a chambering portion at least partially positioned within said sleeve, said chambering portion having a forward end remote from the head end, and a rearward end telescopically interfitted with said sleeve with a containing engagement;

3) a primer for initiating the evolvement of gas upon firing;

4) the casing and chambering portion defining a cavity for containing gas evolved on firing;

5) the chambering portion comprising a longitudinal passageway extending from its forward end to its rearward end to allow for gas to escape from the cavity; and 6) a sealing disc overlying the rearward end of the chambering portion, wherein the sealing disc extends to form at its outer circumferential perimeter a sealing contact with said sleeve and wherein said sealing disc is provided with a pathway to allow a metered release of gas evolving from within the cartridge cavity into the longitudinal passageway upon firing.

5. A cartridge as in claim 4 wherein said chambering portion comprises a recess or protrusion formed in its rearward end and said sealing disc comprises a complementary disc protrusion or disc opening interfitted with said chambering portion recess or protrusion to position the sealing disc on the chambering portion.

6. A cartridge as in claim 4 wherein a rim extends from the outer circumferential perimeter of the sealing disc to lie between the chambering portion and the cartridge sleeve.

7. A cartridge as in claim 5 wherein a rim extends from the outer circumferential perimeter of the sealing disc to lie between the chambering portion and the cartridge sleeve.

8. A cartridge as in claim 6 wherein the rearward end of the chambering portion carries a circumferential flange and said rim carries a hooked lip that engages with said flange with a snap-fit.

9. A cartridge as in claim 8 wherein the circumferential flange has an outer edge that is conically bevelled to receive the sealing disc in said snap-fit engagement.

10. A cartridge as in claim 9 wherein the sealing disc has a complementary shaped surface that lies against the conically bevelled edge.

11. A cartridge as in claim 4 wherein the sealing disc comprises around its outer circumferential perimeter a rearwardly-directed sealing flange that bears against the inner wall of the sleeve.

12. A cartridge as in claim 5 wherein the sealing disc comprises around its outer circumferential perimeter a rearwardly-directed sealing flange that bears against the inner wall of the sleeve when said chambering portion comprises said protrusion and said disc comprises said disc opening.

13. A cartridge as in claim 6 wherein the sealing disc comprises around its outer circumferential perimeter a rearwardly-directed sealing flange that bears against the inner wall of the sleeve.

14. A cartridge as in claim 7 wherein the sealing disc comprises around its outer circumferential perimeter a rearwardly-directed sealing flange that bears against the inner wall of the sleeve when said chambering portion comprises said protrusion and said disc comprises said disc opening.

15. A cartridge as in claim 8 wherein the sealing disc comprises around its outer circumferential perimeter a rearwardly-directed sealing flange that bears against the inner wall of the sleeve.

16. A cartridge as in claim 9 wherein the sealing disc comprises around its outer circumferential perimeter a rearwardly-directed sealing flange that bears against the inner wall of the sleeve.

17. A cartridge as in claim 10 wherein the sealing disc comprises around its outer circumferential perimeter a rearwardly-directed sealing flange that bears against the inner wall of the sleeve.

* * * * *